United States Patent [19]

Mae

[11] 3,965,811

[45] June 29, 1976

[54] APPARATUS FOR SUPPLYING OBJECTS TO BE BOUND TO AN AUTOMATIC BAND-BINDING MEANS

[75] Inventor: Shinroku Mae, Tokyo, Japan

[73] Assignee: Motosuke Umezu, Tokyo, Japan

[22] Filed: Aug. 8, 1975

[21] Appl. No.: 603,234

[30] Foreign Application Priority Data

Dec. 4, 1974 Japan ..... 49-139958

[52] U.S. Cl. ..... 100/4; 100/7; 100/14; 198/21; 198/106; 53/76

[51] Int. Cl.[2] ..... B65B 13/06; B65B 13/18

[58] Field of Search ..... 100/4, 7, 14, 26; 53/67, 76, 75; 198/106, 21

[56] References Cited

UNITED STATES PATENTS

| | | | |
|---|---|---|---|
| 2,684,626 | 7/1954 | Eberle | 100/14 X |
| 3,057,289 | 10/1962 | Luthi | 100/14 UX |
| 3,916,599 | 11/1975 | Shinroku et al. | 53/76 |

FOREIGN PATENTS OR APPLICATIONS

| | | | |
|---|---|---|---|
| 1,073,145 | 6/1967 | United Kingdom | 100/14 |

*Primary Examiner*—Billy J. Wilhite
*Attorney, Agent, or Firm*—Wenderoth, Lind & Ponack

[57] ABSTRACT

An apparatus for supplying objects to be bound to an automatic band-binding means in packing boxes or the like. The apparatus has two groups of conveyers positioned at the same height, one of the groups of conveyers being contiguous to the automatic band-binding means; a push rod which reciprocates with respect to said automatic band-binding means; a pushing means fixed to the end of the push rod and provided with a pushing member disposed laterally of the push rod, the pushing member being adapted to take the position between the two groups of conveyers as its starting position and having springs for putting it up higher than the conveyers during the movement of the push rod; a stopper means adapted to engage with the pushing means to hold it on a level with the conveyers as long as the push rod remains stationary; a plurality of selection means for band-binding positions located between the automatic band-binding means and the push rod at the different intervals corresponding to band-binding positions; means for reducing the running velocity of each selection means corresponding to the distance from the band-binding means with respect to the running velocity of the push rod; and means for stopping the selection means for band-binding positions when the object reaches a point just ahead of the automatic band-binding means; whereby said push rod is moved to supply the object to be bound to the automatic band-binding means and stopped at every stop position of said selection means to permit carrying out of band-binding.

5 Claims, 8 Drawing Figures

APPARATUS FOR SUPPLYING OBJECTS TO BE BOUND TO AN AUTOMATIC BAND-BINDING MEANS

BACKGROUND OF THE INVENTION

This invention relates to an apparatus for supplying objects to be bound to an automatic band-binding means in which the objects are put in sequence in the fixed position into the automatic band-binding means and the band-binding operation is automatically effected at several places on each object.

When it is desired to automatically and successively bind with bands objects which are continuously fed to an apparatus for binding with bands by means of a conveyer system (not shown) arranged in front of and at the back of said apparatus, an operator has only to watch whether or not the objects to be bound with bands are fed in order to the apparatus, if packing positions are detected by the apparatus and, therefore, it is possible to achieve a sharp reduction in the number of working personnel and in the work burden.

Most manufactured products produced in large quantities are packed in cartons or wooden cases for shipping. In addition, in most cases, such packed articles are bound with bands to prevent disorder thereof.

If the size of objects to be bound with bands is fixed, it will be easy to select automatically the positions where the objects are bound with bands. On the contrary, if objects of different sizes to be bound with bands are fed in a random sequence to an automatic band-binding means, it will be necessary to distinguish the sizes of the objects and to provide means for effecting the band-binding operation at desired positions.

Apparatuses for binding according to the prior art were effectively usable for objects of a fixed size which were to be bound with bands, but were not capable of binding objects of different sizes supplied in a random sequence because such apparatuses have no ability to measure the sizes of the objects to be bound with bands. There has been as yet no proposal of a mechanism for selecting band-binding positions.

SUMMARY OF THE INVENTION

This invention is intended to provide an apparatus for automatically and successively binding with bands objects of different sizes to be bound with bands at predetermined binding positions in process of a binding boxes or the like.

According to the present invention, all of the articles including corrugated cardboard boxes, wooden materials such as veneer boards and metallic products in the form of a cylinder, plate, or the like can be bound with bands and, as will be described in detail in the specification, any article that can be put between a band-binding means and a starting point of the operation of a push rod can be bound with bands at predetermined positions.

The apparatus for binding with bands of the present invention is such that an object to be bound with bands is transported by conveyers, measured in length during transportation prior to arrival at the band-binding means, put in the means after selection of the positions predetermined by the measured length of the object, and stopped at the positions corresponding to the predetermined length, whereby a band-binding operation is effected. The present apparatus is capable of band-binding objects of different sizes to be bound with bands at fixed positions, even when they are fed in a random sequence.

Automatic selection of band-binding positions in the present invention means that, if for example three selection mechanisms for band-binding positions are located between the starting point of the operation of a push rod and the band-binding means at positions 1/6, 3/6 and 5/6 away from the end of either one, a band-binding operation is effected on the object to be bound with bands at intervals of the rations of 1/6, 3/6 and 5/6 which are determined by the selection mechanisms for the band-binding positions.

According to the present invention, the conveyers for feeding objects to be bound to the band-binding means are places on a level so that the objects can be transported with great certainty from a first group of conveyers to a second group. In case the second group of conveyers where the push rod moves are positioned lower than the first group for feeding the objects to be bound to the second group, the objects are slanted at the position where one group of conveyors are adjacent to the other group and slided onto the lower group. In such a case, when the object to be bound is relatively light or has the center of gravity at a relatively low position thereof, it can be carried onto the lower conveyers in disregard of unevenness of the groups of conveyers. On the contrary, when the object is heavy or has the center of gravity at a high position thereof, it may stop at the uneven portion where one group of conveyers are adjacent to the other group and, accordingly, it may not be fed to the band-binding means. The apparatus according to the present invention can accomplish the reliable band-binding operation on every object to be bound since the two groups of conveyers are arranged in a level.

DETAILED DESCRIPTION OF THE PREFERRED EMBODIMENTS

Figure 1:
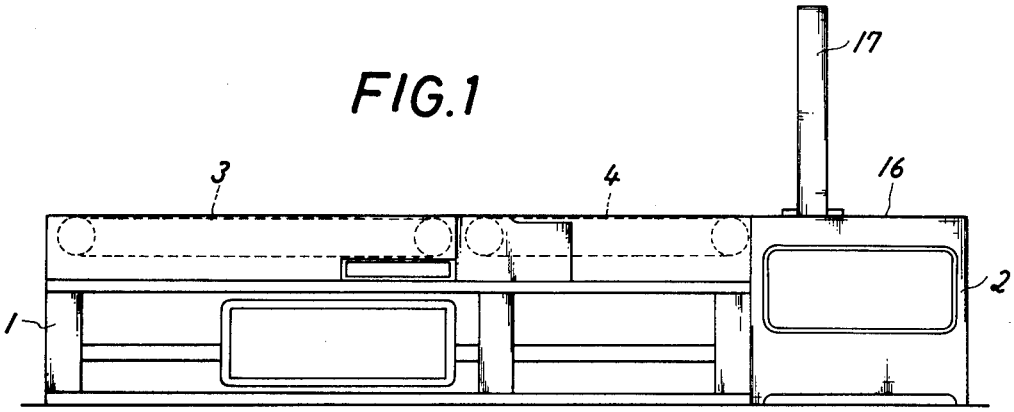
FIG. 1 is a schematic side view of an apparatus of the present invention for supplying objects to be bound and an automatic band-binding means connected thereto.
Figure 2:
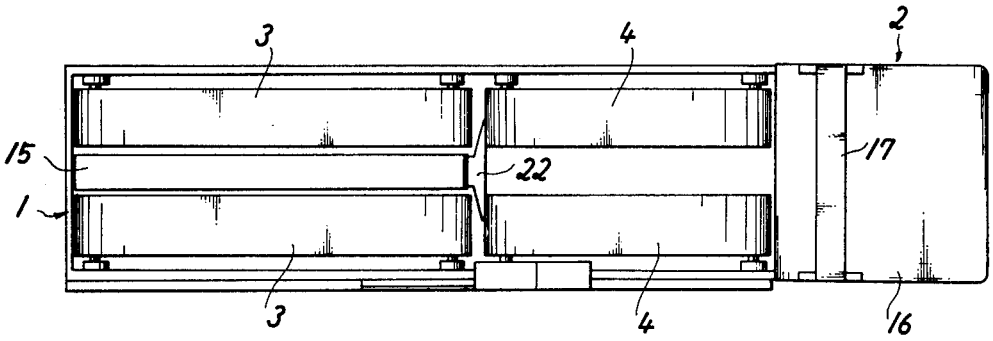
FIG. 2 is a schematic plan view of the apparatus of the present invention.
Figure 3:
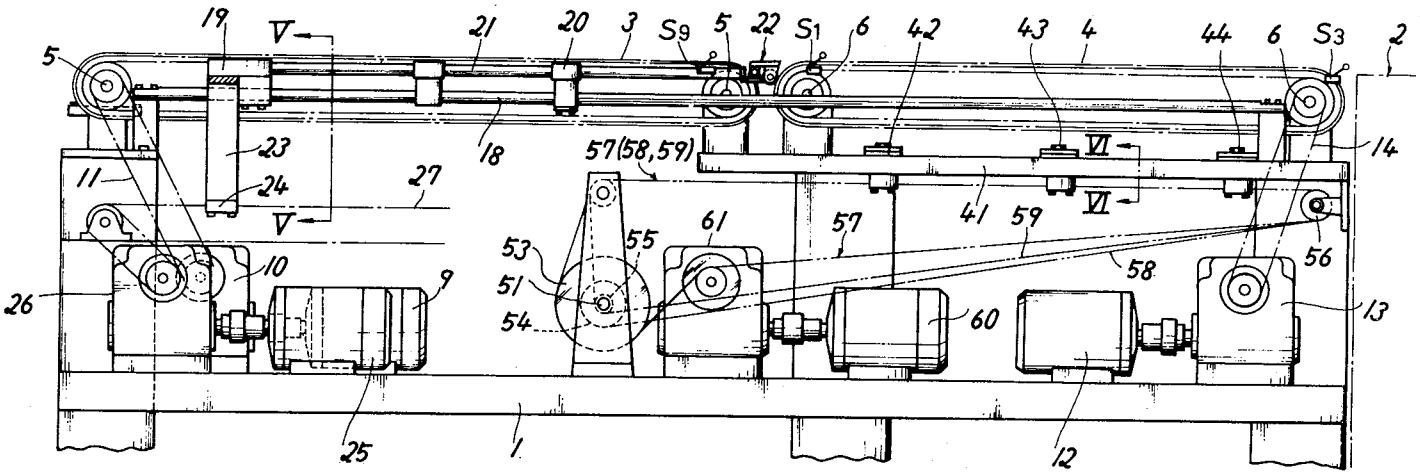
FIG. 3 is a partial sectional side view of the apparatus showing details thereof.
Figure 4:
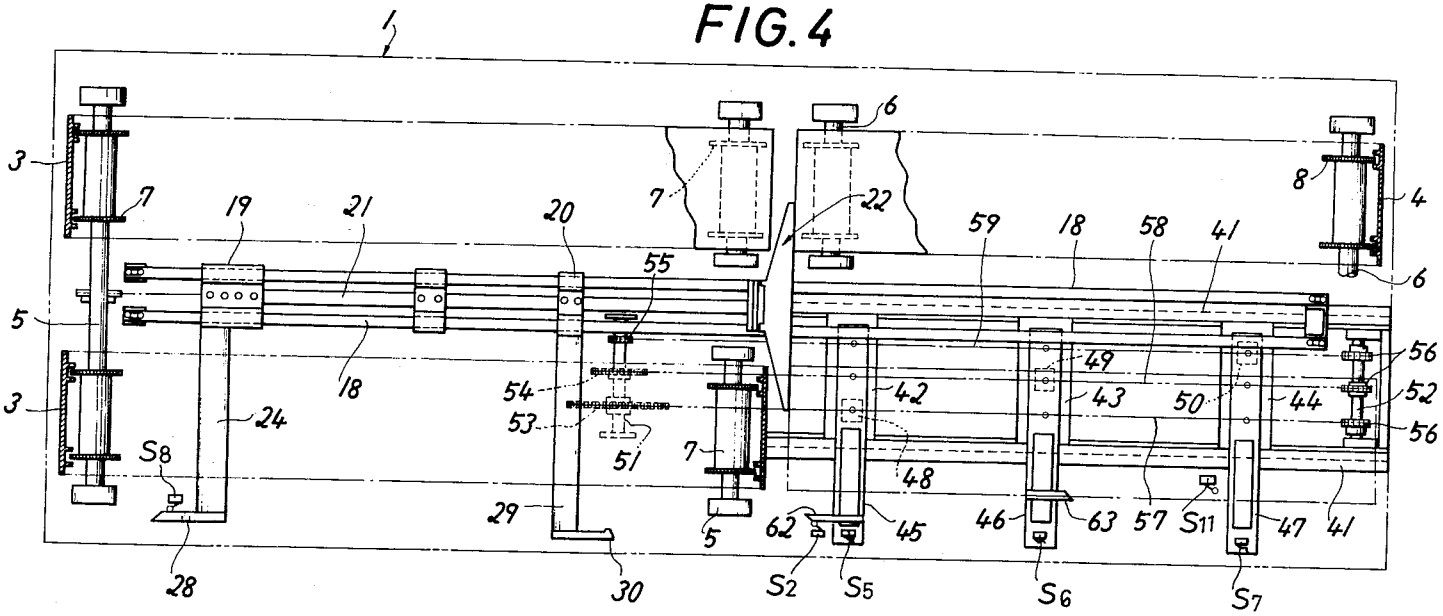
FIG. 4 is a partial fragmentary plan view of the apparatus showing details thereof.
Figure 6:
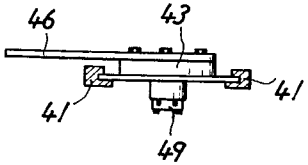
FIG. 6 is a cross sectional view taken along the line VI—VI of FIG. 3.
Figure 5:
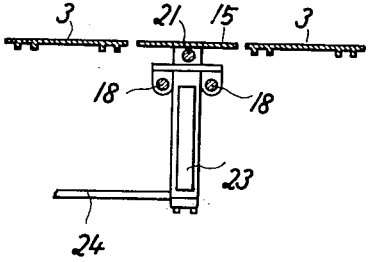
FIG. 5 is a cross sectional view taken along the line V—V of FIG. 3.

The present invention will now be described in detail with reference to the drawings.

Reference numeral 1 designates a frame in which an apparatus of the present invention for supplying objects to be bound is set. On a side wall of the frame 1 is provided an automatic band-binding means 2 and at the upper portion of the frame 1 are provided conveyers 3 in two rows. Auxiliary conveyers 4 are disposed between the conveyers 3 and the automatic band-binding means 2 and in two rows corresponding to those of the conveyers 3.

The conveyers 3 and 4 are driven by driving wheels 7 and 8, which are secured to rotary shafts 5 and 6, respectively, supported by the frame 1. Each of the inner shafts 5 and 6 positioned where the two groups of conveyers adjoin is composed of two shafts with a space midway therebetween. One of the shafts 5 for the conveyers 3 is driven with chain 11 by a motor 9, which is mounted on the frame 1, through a reduction gear 10, so that the conveyers 3 are moved. In like manner, one of the shafts 6 is driven with a chain 14 by a motor 12, which is also mounted on the frame 1, through a reduction gear 13, so that the conveyers 4 are moved. Between the conveyers 3 and at a position slightly lower than the upper surface of the conveyers 3 is disposed a supporting plate 15.

The conveyers 3 and the auxiliary conveyers 4 are arranged on a level with the working surface 16 of the automatic band-binding means 2. The automatic band-binding means 2 is provided with an arch 17 for supplying packing tapes. The means 2 effects a tape-binding operation when the object to be bound is brought under the arch 17.

A pair of guide rods 18 are arranged below and parallel to the conveyers 3 and 4 and secured on the frame 1. The guide rods 18 are slidably inserted through supporting elements 19 and 20 to which a push rod 21 is fixed in a parallel relationship to the conveyers. Each guide rod 18 has substantially the same length as that of the corresponding conveyer while the push rod 21 has such a length that its end provided with a pushing means 22 can occupy the point where the conveyers 3 are adjacent to the auxiliary conveyers 4 when the supporting element 19 is retreated the most as shown in the drawings.

The supporting element 19 is provided with a downwardly extending coupling arm 23 which has a laterally extending arm 24 and to which a chain 27 is coupled. The chain 27 is driven by a motor 25, which is secured to the frame 1, through a reduction gear 26, so that the push rod 21 is moved by rotation of the motor 25. A dog 28 is fixed to the tip of the arm 24 for operating a switch $S_8$. In addition, the other supporting element 20 has also a laterally extending arm 29 which has on its tip a dog 30.

Figure 7:
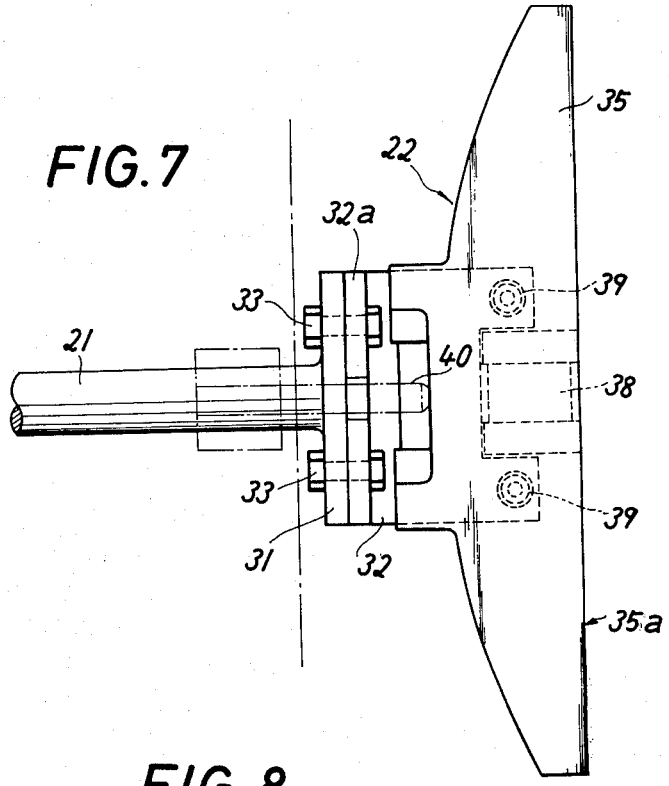
FIG. 7 is a plan view of a pushing means connected to the end of a push rod for transporting objects to be bound from conveyers to the band-binding means.
Figure 8:
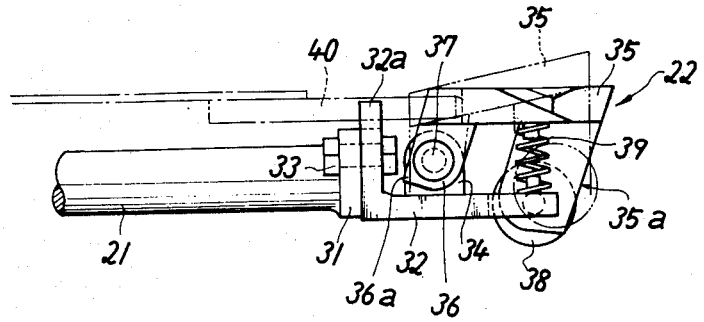
FIG. 8 is a side view of the pushing means illustrated in FIG. 7.

The pushing means 22 will be shown in detail in FIGS. 7 and 8. The push rod 21 has on its end a fixing element 31 to which a portion 32*a* of a bracket 32 is fixed by means of bolts 33. The bracket 32 has a bearing member 34 which is coupled to bearing plates 36 extending downwardly from a pushing blade 35 by means of a shaft 37 extending laterally of the push rod 21. It should be noted that the pushing blade 35 is mounted rotatably in the lateral direction of the push rod 21.

The other side of the pushing blade 35, i.e. the side opposite to its connected portion described above, functions as a pushing face 35*a*. The pushing face 35*a* has at its lower end a roller 38 which, until the object to be bound which had reached the working surface 16 of the automatic band-binding means 2 is put under the arch 17, rotates against the working surface 16 so as to support the pushing blade 35. Between the bracket 32 and the pushing blade 35 are mounted springs 39 which provide the pushing blade 35 shown in FIG. 8 with the counter-clockwise force so as to rotate it until the pushing face 35*a* become vertical. Then, when it becomes vertical, stoppers 36*a* of the bearing plates 36 causes it to a stop. In such a position, the pushing blade 35 projects over the conveyers 3 and 4 and pushes the object to be bound from the conveyers 4 to the automatic band-binding means.

The frame 1 is provided with an additional stopper 40, which keeps the pushing blade 35 even with the conveyers 3 and 4 before the push rod 21 starts moving, that is, when the push rod 21 is retreated the most. The stopper 40 engages with a shoulder of the pushing blade 35 when the push rod 21 occupies its backmost position, so that the pushing blade 35 can turn clockwise in FIG. 8 against the force of the springs 39 and be maintained on a level with the conveyers 3 and 4 as shown by solid lines in FIG. 8. It will be understood that, while the pushing blade 35 is so kept, the object to be bound can be carried from the conveyers 3 to the auxiliary conveyers 4.

Sliding grooves 41 are supported by the frame 1 right under and in parallel with the auxiliary conveyers 4. The two sliding grooves are disposed in such a manner that the grooved portions thereof are positioned inside facing to each other. In the sliding grooves 41 are slidably mounted base plates 42, 43 and 44 which are positioned at the positions of 5/6, 3/6 and 1/6 of the whole length, assuming it to be 1, respectively, of the groove 41 from its end which is adjacent to the automatic band-binding means. Arms 45, 46 and 47, all extending to the same direction, are mounted on the upper surfaces of the base plates 42, 43 and 44, respectively.

Switches $S_5$, $S_6$ and $S_7$ are disposed in line with each other on the ends of the arms 45, 46 and 47, respectively, and engaging members 48, 49 and 50 are arranged out of line on the lower surfaces of the base plates 42, 43 and 44, respectively. Shafts 51 and 52 are positioned substantially under the edges of the sliding grooves 41. The shaft 51 is provided with three chain pulleys 53, 54 and 55, the gear ratio of which is 5:3:1 while the shaft 52 is provided with additional three chain pulleys 56 all having the same number of teeth. These chain pulleys 53, 54, 55 and 56 are engaged with corresponding chains 57, 58 and 59.

The chain 57 engaged with the chain pulley 53 of the most teeth, the chain 58 engaged with the chain pulley 54 of the middle number of teeth, and the chain 59 engaged with the chain pulley 55 of the least teeth are coupled to the engaging members 48, 49 and 50 of the arms 45, 46 and 47, respectively. The chain 57 is coupled to a reduction gear 61 of a motor 60 and the running velocity of the chain 57 is set to be 5/6 of the running velocity of the chain 27 driving the push rod 21. Thus the running velocities of the base plates 42, 43 and 44 will be 5/6, 3/6 and 1/6 of the running velocity of the push rod 21, respectively. Thus, when the movement of the push rod is stopped and, simultaneously therewith, the motor 60 is stopped, the positional relation among the base plates with respect to the automatic band-binding means is 1/6, 3/6 and 5/6 in accordance with the relation of the predetermined distances thereof as described above.

The arms 45 and 46 have a dog 62 for operating a switch $S_2$ and a dog 63 for operating a switch $S_{11}$, respectively.

The conveyers 3 and 4 are driven by the respective motors 9 and 12 and an object to be bound is put on the conveyers 3 for transportation. Then the object to be bound passes the conveyers 3 and arrives the auxiliary conveyers 4. When the object passes the switch $S_1$, the motor 12 is stopped, causing the auxiliary conveyers 4 to stop their running, and the motors 25 and 60 are simultaneously energized. The working of the motor 25 causes the push rod 21 to advance so that the pushing blade 35 on the tip of the push rod becomes out of engagement with the stopper 40 and the pushing blade 35 is rotated by means of the springs 39 so as to project above the upper surface of the auxiliary conveyers 4. Then the advance of the push rod 21 brings the pushing blade 35 into touch with the rear face of the object and pushes it toward the automatic band-binding means. When the object to be bound operates the switch $S_3$ mounted on the end of the auxiliary conveyers 4, the motor 60 is stopped.

The motor 60 for moving the base plates 42, 43 and 44 is energized at the same time that the push rod 21 starts moving and stopped by the working of the switch $S_3$. This operation is intended to measure the length of the object to be bound and stop the switches $S_5$, $S_6$ and $S_7$ at the positions of 5/6, 3/6 and 1/6, respectively, from the front face of the object placed just before the automatic band-binding means.

During this operation, the motor 25 is continuously energized to advance the push rod 21 without stopping. When the push rod 21 brings the object to be bound under the arch 17 of the automatic band-binding means, the dog 30 of the arm 29 of the push rod 21 acts on the switch $S_5$ so that the motor 25 is stopped and the automatic band-binding means is started to effect a tape-binding operation. Upon detection of completion of the binding operation, the motor 25 is again operated to advance the push rod 21 and the dog 30 engages with the switch $S_6$ so as to stop the motor 25, so that the band-binding operation is similarly accomplished. The next band-binding operation will be effected in like manner when the dog 30 engages with the switch $S_7$.

The auxiliary conveyers 4 move only for a period of transportation of the object from the conveyers 3 to the conveyers 4 and, except that period, they stand still. The objects to be bound may be successively supplied to the conveyers 3 but not to the conveyers 4. In order to provide the auxiliary conveyers 4 with only one object to be bound and prevent an object to be bound from being sent to the auxiliary conveyers 4 before completion of binding the precedent object with tapes, a switch $S_9$ is provided in the end portion of the conveyers 3 for stopping the motor 9 and, accordingly, the conveyers 3 upon engagement with the object. When the band-binding operation is completed at three places in this way, each operative member will retire and be ready for the next operation.

If it is desired to change the tape-binding positions on the object, the base plates 42, 43 and 44 provided with the switches $S_5$, $S_6$ and $S_7$, respectively, for generating starting signals for band-binding in the operational range of the push rod 21 are set at the proper positions and the running velocities of the base plates are made proportional to their respective set distances with respect to the running velocity of the push rod.

As may be seen from the above, the present invention provides an apparatus in which objects to be bound with tapes are fed to the automatic band-binding means and the objects, even of different sized, can be bound with tapes at predetermined binding positions.

What is claimed is:

1. An apparatus for supplying objects to be bound to an automatic band-binding means, the apparatus comprising two groups of conveyers positioned at the same height, one of said groups of conveyers being arranged close to the automatic band-binding means; a push rod which reciprocates with respect to said automatic band-binding means; a pushing means fixed to the end of the push rod and provided with a pushing member disposed laterally of the push rod, said pushing member being adapted to take the position between the two groups of conveyers as its starting position and having springs which put it up higher than the conveyers during the movement of the push rod; a stopper means adapted to engage with the pushing means to hold it on a level with the conveyers as long as the push rod remains stationary; a plurality of selection means for band-binding positions located between the automatic band-binding means and the push rod at the different intervals corresponding to band-binding positions; means for reducing the running velocity of each selection means corresponding to the distance from the band-binding means with respect to the running velocity of the push rod; and means for stopping said selection means for band-binding positions when the object reaches a point just ahead of the automatic band-binding means; whereby said push rod is moved to supply the object to be bound to the automatic band-binding means and stopped at every stop position of said selection means to permit carrying out of band-binding.

2. An apparatus for supplying objects to be bound to an automatic band-binding means as set forth in claim 1, wherein each of said two groups of conveyers arranged in a level has a longitudinal, central space where said push rod provided with said pushing means moves.

3. An apparatus for supplying objects to be bound to an automatic band-binding means as set forth in claim 1, wherein said pushing means further includes a bracket secured to the end of said push rod, a bearing member provided to said bracket and bearing plates provided to said pushing blade and connected with said bearing member by means of a shaft extending laterally of the push rod, said bracket and said pushing blade having said springs therebetween.

4. An apparatus for supplying objects to be bound to an automatic band-binding means as set forth in claim 3, wherein each bearing plate of said pushing member forming a part of the pushing means has a right-angled stopper which engages with said bracket during the movement of said push rod so as to hold the pushing face of said pushing member vertical.

5. An apparatus for supplying objects to be bound to an automatic band-binding means as set forth in claim 3, wherein said pushing means further includes a roller provided at the lower end of said pushing member and adapted to support said pushing member until the object to be bound which had reached the working surface of the automatic band-binding means is fed to the binding position of the automatic band-binding means.

* * * * *